US008096113B2

(12) United States Patent
Aoyama et al.

(10) Patent No.: US 8,096,113 B2
(45) Date of Patent: Jan. 17, 2012

(54) EXHAUST PURIFICATION SYSTEM FOR INTERNAL COMBUSTION ENGINE

(75) Inventors: Taro Aoyama, Susono (JP); Mikio Inoue, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 545 days.

(21) Appl. No.: 12/087,918

(22) PCT Filed: Jan. 25, 2007

(86) PCT No.: PCT/JP2007/051652

§ 371 (c)(1),
(2), (4) Date: Jul. 17, 2008

(87) PCT Pub. No.: WO2007/086598

PCT Pub. Date: Aug. 2, 2007

(65) Prior Publication Data

US 2009/0077950 A1 Mar. 26, 2009

(30) Foreign Application Priority Data

Jan. 25, 2006 (JP) ..... 2006-016299

(51) Int. Cl.
*F01N 3/18* (2006.01)

(52) U.S. Cl. ..... 60/295; 60/284

(58) Field of Classification Search ..... 60/284, 60/285, 286, 295, 301
See application file for complete search history.

(56) References Cited

U.S. PATENT DOCUMENTS

| | | | |
|---|---|---|---|
| 6,626,033 | B1 | 9/2003 | Schnaibel et al. |
| 6,854,265 | B2 | 2/2005 | Saito et al. |
| 2003/0131592 | A1 | 7/2003 | Saito et al. |

FOREIGN PATENT DOCUMENTS

| | | | |
|---|---|---|---|
| EP | 1 510 679 | A2 | 3/2005 |
| EP | 1 515 016 | A2 | 3/2005 |
| JP | A-10-54274 | | 2/1998 |
| JP | 2002097939 | A * | 4/2002 |
| JP | A-2002-97939 | | 4/2002 |
| JP | A 2003-206723 | | 7/2003 |
| JP | A 2004-108176 | | 4/2004 |
| JP | A 2005-76505 | | 3/2005 |
| JP | A 2005-90277 | | 4/2005 |
| JP | A 2005-337153 | | 12/2005 |

OTHER PUBLICATIONS

Office Action issued for Japanese Patent Application No. 2006-016299 mailed Oct. 6, 2009.

* cited by examiner

*Primary Examiner* — Thomas Denion
*Assistant Examiner* — Jonathan Matthias
(74) *Attorney, Agent, or Firm* — Oliff & Berridge, PLC

(57) ABSTRACT

The exhaust purification system for an internal combustion engine according to the present invention includes fuel supply means for supplying fuel to the NOx storage-reduction catalyst from the upstream side thereof, and SOx poisoning recovery control executing means that uses the fuel supply means to supply fuel to the NOx storage-reduction catalyst thereby executing the SOx poisoning recovery control at a predetermined interval during operation of the internal combustion engine. In addition, according to the present invention, the execution of the SOx poisoning recovery control by the SOx poisoning recovery control executing means is prohibited during a predetermined period DELTA Qfen2 starting from a point in time that the operation of the internal combustion engine is initially started. The predetermined period DELTA Qfen2 is longer than a predetermined interval DELTA Qfen1.

1 Claim, 2 Drawing Sheets

EXHAUST PURIFICATION SYSTEM FOR INTERNAL COMBUSTION ENGINE

TECHNICAL FIELD

The present invention relates to an exhaust purification system for an internal combustion engine including a NOx storage-reduction catalyst that is disposed in an exhaust passage of the internal combustion engine.

BACKGROUND ARTS

A known exhaust purification system for an internal combustion engine includes a NOx storage-reduction catalyst (hereinafter simply referred to as a "NOx catalyst") that stores nitrogen dioxides (NOx) in exhaust gas when the surrounding atmosphere is an oxidative atmosphere and that reduces the stored NOx when the surrounding atmosphere is a reduction atmosphere.

In the same manner as NOx, sulfur oxides (SOx) in the exhaust gas are also stored in the NOx catalyst. When the amount of SOx stored in the NOx catalyst increases, the NOx storage capacity of the NOx catalyst decreases. Therefore, in the exhaust purification system for an internal combustion engine including a NOx catalyst, what is referred to as SOx poisoning recovery control for reducing the SOx stored in the NOx catalyst is carried out.

Japanese Patent Application Publication No. JP-A-2005-90277 discloses a technology that starts SOx poisoning recovery control when an amount of SOx stored in a NOx catalyst reaches a maximum and subsequently stops the SOx poisoning recovery control when the amount of SOx stored in the NOx catalyst reaches a minimum. Japanese Patent Application Publication No. JP-A-2005-90277 discloses a technology that changes the maximum and minimum amounts for the stored SOx in accordance with the concentration of SOx in fuel that is used for operation of the internal combustion engine. Japanese Patent Application Publication No. JP-A-2004-108176 and Japanese Patent Application Publication No. JP-A-2005-76505 disclose technologies related to the SOx poisoning recovery control. Still further, Japanese Patent Application Publication No. JP-A-2003-206723 discloses a technology relating to a regeneration method for a particulate filter.

DISCLOSURE OF THE INVENTION

In an exhaust purification system for an internal combustion engine including a NOx catalyst, it is difficult to measure an amount of SOx stored in the NOx catalyst. Therefore, SOx poisoning recovery control is typically carried out during the operation of the internal combustion engine at a predetermined interval that is determined based on a traveling distance of a vehicle having the internal combustion engine, the integrated amount of fuel injected in the internal combustion engine, and the like.

In addition, the SOx poisoning recovery control is carried out by supplying the fuel to the NOx catalyst from the upstream side thereof so as to raise the temperature of the NOx catalyst and cause a surrounding atmosphere to be a reduction atmosphere. Therefore, if the SOx poisoning recovery control is carried out more frequently, there is a concern that deterioration in fuel economy or degradation of the NOx catalyst may accelerate.

The present invention is accomplished in view of the problems described above, and it is an object thereof to execute the SOx poisoning recovery control at more advantageous timings in the exhaust purification system for an internal combustion engine including the NOx catalyst that is disposed in the exhaust passage of the internal combustion engine, thereby suppressing the deterioration in fuel economy and the degradation of the NOx catalyst.

According to the present invention, the execution of SOx poisoning recovery control, which is executed at a predetermined interval during the operation of the internal combustion engine, is prohibited during a predetermined period starting from the point in time that the operation of the internal combustion engine is initially started. The predetermined period is longer than the predetermined interval.

More specifically, the exhaust purification system for an internal combustion engine according to the present invention includes:

a NOx storage-reduction catalyst that is disposed in an exhaust passage of the internal combustion engine, that stores NOx in exhaust gas when a surrounding atmosphere is an oxidative atmosphere, and that reduces the stored NOx when the surrounding atmosphere is a reduction atmosphere;

fuel supply means for supplying fuel to the NOx storage-reduction catalyst from an upstream side thereof; and SOx poisoning recovery control executing means that uses the fuel supply means to supply fuel to the NOx storage-reduction catalyst so as to raise a temperature of the NOx storage-reduction catalyst and cause the surrounding atmosphere to be the reduction atmosphere, thereby executing, at a predetermined interval during operation of the internal combustion engine, a SOx poisoning recovery control that reduces SOx stored in the NOx storage-reduction catalyst, wherein the execution of the SOx poisoning recovery control by the SOx poisoning recovery control executing means is prohibited during a predetermined period starting from the point in time that the operation of the internal combustion engine is initially started, with the predetermined period being longer than the predetermined interval.

Here, the predetermined interval may be defined as an interval that starts from the point in time that the execution of the previous SOx poisoning recovery control is stopped to the point in time that the amount of SOx stored in the NOx catalyst is estimated to reach a predetermined storage amount. In this case, the predetermined storage amount is smaller than a threshold value at which it is determined that a NOx storage capacity of the NOx catalyst has excessively decreased, and is determined in advance. In addition, the predetermined interval may be determined in advance based on a traveling distance of the vehicle or an integrated amount of fuel injected in the internal combustion engine or the like.

When the SOx poisoning recovery control is executed, fuel is supplied from the upstream side of the NOx catalyst. At this time, in the vicinity of a front end portion (an end portion on the upstream side along the direction of exhaust flow) of the NOx catalyst, it is difficult for the supplied fuel to be sufficiently vaporized such that it functions as a reducing agent. Also, it is difficult for the air-fuel ratio of the exhaust gas to decrease sufficiently to produce a reduction atmosphere. Therefore, even if the SOx poisoning recovery control is executed, SOx stored in the vicinity of the front end portion of the NOx catalyst is not reduced and remains stored.

After the operation of the internal combustion engine is initially started (that is, when SOx is not stored in the NOx catalyst, after the operation of the internal combustion engine is started), the SOx is gradually stored in the NOx catalyst from the vicinity of the front end portion thereof. Therefore, in early stages during which the operation of the internal combustion engine is initially started and the SOx is stored in the vicinity of the front end portion of the NOx catalyst, even if the SOx poisoning recovery control is normally executed at the predetermined interval, it is difficult for the SOx stored in the NOx catalyst to be reduced. In addition, while the SOx is stored only in the vicinity of the front end portion of the NOx catalyst, the amount of SOx stored in the NOx catalyst does not reach the predetermined storage amount.

Thus, according to the present invention, the execution of the SOx poisoning recovery control by the SOx poisoning recovery control executing means is prohibited during the predetermined period starting from the point in time that the operation of the internal combustion engine is initially started. The predetermined period is longer than the predetermined interval.

Thereby, unnecessary execution of the SOx poisoning recovery control can be reduced. In other words, according to the present invention, the SOx poisoning recovery control can be carried out at more advantageous timings. As a result, deterioration in fuel economy and degradation of the NOx catalyst can be suppressed.

According to the present invention, the predetermined period may be a period that lasts until the NOx catalyst starts storing SOx that can be reduced by executing the SOx poisoning recovery control.

Thereby, according to the present invention, unnecessary execution of the SOx poisoning recovery control can further be reduced.

Note that, according to the present invention, the predetermined period may be determined, as in the case of the predetermined interval, based on the traveling distance of the vehicle or the integrated amount of fuel injected in the internal combustion engine or the like.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENT

Hereinafter, a specific embodiment of an exhaust purification system for an internal combustion engine according to the present invention will be explained with reference to the drawings.

Embodiment 1

<Schematic Configuration of an Intake and Exhaust System of an Internal Combustion Engine>

Figure 1:
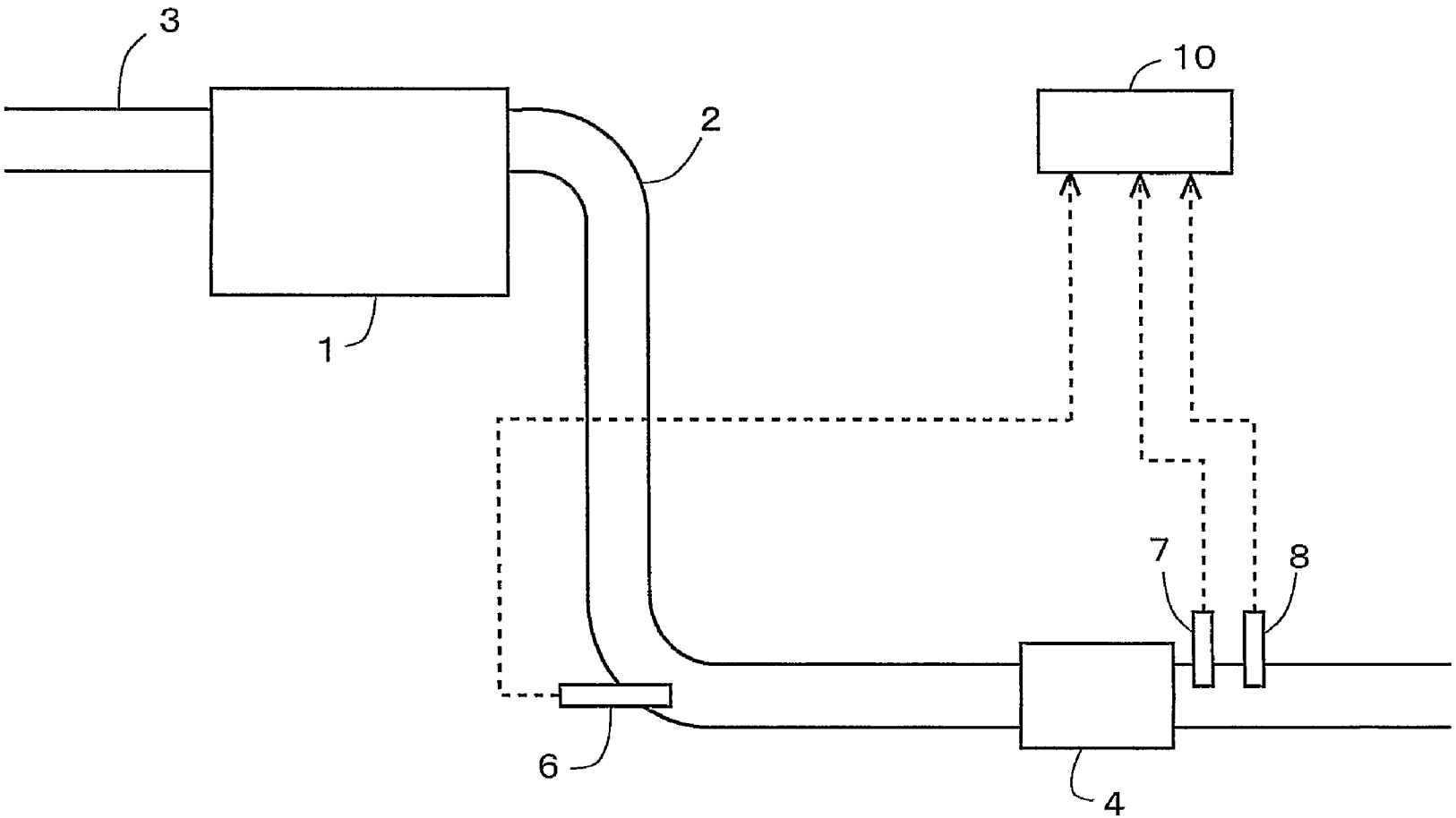
FIG. 1 is a diagram schematically showing a configuration of an intake and exhaust system for an internal combustion engine according to an embodiment of the present invention.

Here, an example in which the present invention is applied to a diesel engine for driving a vehicle is described. FIG. 1 is a diagram schematically showing a configuration of an intake and exhaust system for the internal combustion engine according to the present embodiment.

An internal combustion engine 1 is a diesel engine for driving a vehicle. An intake passage 3 and an exhaust passage 2 are connected to the internal combustion engine 1. A NOx storage-reduction catalyst 4 (hereinafter simply referred to as "NOx catalyst 4") is disposed in the exhaust passage 2. The NOx catalyst 4 stores NOx in exhaust gas when a surrounding atmosphere is an oxidative atmosphere, and reduces the stored NOx when the surrounding atmosphere is a reduction atmosphere. A fuel-adding valve 6 for adding fuel into the exhaust gas is disposed in the exhaust passage 2 that is to the upstream side of the NOx catalyst 4.

Further, an air-fuel ratio sensor 7 for detecting an air-fuel ratio of the exhaust gas and an exhaust temperature sensor 8 for detecting the temperature of the exhaust gas are disposed on the downstream side of the NOx catalyst 4 in the exhaust passage 2.

An electronic control unit (ECU) 10 for controlling the internal combustion engine 1 is provided together with the internal combustion engine 1 having the configuration described above. The ECU 10 is electrically connected to the air-fuel ratio sensor 7 and the exhaust temperature sensor 8, and signals output from these sensors are input to the ECU 10. The ECU 10 estimates the temperature of the NOx catalyst 4 based on detection values of the exhaust temperature sensor 8.

The fuel-adding valve 6 is also electrically connected to the ECU 10. The ECU 10 controls the fuel-adding valve 6. Note that in the present embodiment, the fuel-adding valve 6 corresponds to the fuel supply means according to the present invention, and the ECU 10 corresponds to the SOx poisoning recovery control executing means according to the present invention.

<SOx Poisoning Recovery Control>

NOx catalyst 4 stores not only NOx in the exhaust gas, but also SOx. When the amount of SOx stored in the NOx catalyst 4 increases, the NOx storage capacity of the NOx catalyst 4 decreases. Therefore, according to the present embodiment, SOx poisoning recovery control that reduces SOx stored in the NOx catalyst 4 is carried out.

In the SOx poisoning recovery control, the fuel-adding valve 6 adds fuel, thereby increasing the temperature of the NOx catalyst 4 to a SOx reduction temperature at which the SOx can be reduced and setting the surrounding atmosphere of the NOx catalyst 4 to the reduction atmosphere. The fuel added by the fuel-adding valve 6 is supplied to the NOx catalyst 4. The added fuel is oxidized in the NOx catalyst 4, resulting in generation of heat that increases the temperature of the NOx catalyst 4 to the SOx reduction temperature. In addition, when the fuel is added by the fuel-adding valve 6, the air-fuel ratio of the exhaust gas flowing into the NOx catalyst 4 decreases. As a result, the surrounding atmosphere of the NOx catalyst 4 becomes the reduction atmosphere.

Figure 2:
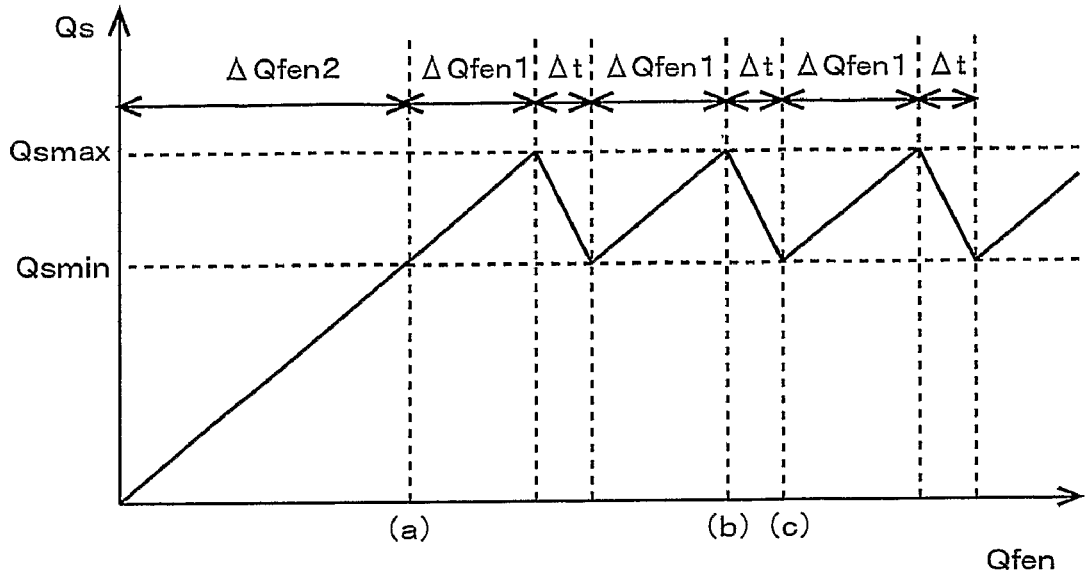
FIG. 2 is a diagram showing an execution timing of a SOx poisoning recovery control and changes in the amount of SOx stored in a NOx catalyst according to the embodiment of the present invention.

Here, the execution timing of the SOx poisoning recovery control and changes in the SOx amount stored in the NOx catalyst 4 according to the present embodiment will be described, based on FIG. 2. In FIG. 2, the vertical axis indicates a SOx storage amount Qs in the NOx catalyst 4, and the horizontal axis indicates an integrated amount Qfen of the fuel injected in the internal combustion engine 1 from the point in time that the operation of the internal combustion engine 1 is initially started.

It is difficult to directly measure the SOx storage amount Qs in the NOx catalyst 4. Therefore, according to the present embodiment, the SOx poisoning recovery control is repeatedly carried out at predetermined intervals during the operation of the internal combustion engine 1. More specifically, during the operation of the internal combustion engine 1, the SOx poisoning recovery control is carried out each time when the integrated amount of fuel injected in the internal combustion engine 1 from the point in time that the execution of the previous SOx poisoning recovery control is stopped reaches a first predetermined integrated amount ΔQfen1. In addition, the execution time of the SOx poisoning recovery control is determined in advance as a predetermined execution time Δt. The predetermined execution time Δt will be described later.

Here, the first predetermined integrated amount ΔQfen1 is a value that is set in such a way that when the integrated amount of fuel injected in the internal combustion engine 1 from the point in time that the execution of the previous SOx poisoning recovery control is stopped reaches the first predetermined integrated amount ΔQfen1, it can be considered that the SOx storage amount Qs in the NOx catalyst 4 reaches a maximum storage amount Qsmax. Note that the maximum storage amount Qsmax is smaller than a threshold value at which it is determined the NOx storage capacity of the NOx catalyst 4 decreases excessively. The maximum storage amount Qsmax is determined in advance, and the first predetermined integrated amount ΔQfen1 is determined in advance, based on the maximum storage amount Qsmax.

According to the present embodiment, when the SOx poisoning recovery control is executed, fuel serving as a reducing agent is supplied to the NOx catalyst 4 from the upstream side thereof. In this case, in the vicinity of a front end portion of the NOx catalyst 4, it is difficult for the supplied fuel to be sufficiently vaporized such that it functions as a reducing agent. Also, it is difficult for the air-fuel ratio of the exhaust gas to decrease sufficiently such that it produces the reduction atmosphere. Therefore, even if the SOx poisoning recovery control is executed, SOx stored in the vicinity of the front end portion of the NOx catalyst 4 is not reduced and remains stored. Here, the amount of SOx that remains stored in the vicinity of the front end portion of the NOx catalyst 4 even if the SOx poisoning recovery control is executed is defined as a minimum storage amount Qsmin.

Thus, according to the present embodiment, the execution time of the SOx poisoning recovery control is determined in advance as the predetermined execution time Δt. That is, after the point in time that the execution of the SOx poisoning recovery control is started (the time point indicated by (b) in FIG. 2, for example), when the execution time Δt elapses (at the time point indicated by (c) in FIG. 2, for example), the execution is stopped. Here, the predetermined execution time Δt is a time during which the SOx storage amount Qs in the NOx catalyst 4 is able to be considered to decrease from the maximum storage amount Qsmax to the minimum storage amount Qsmin due to the SOx poisoning recovery control.

Due to the repeated execution of the SOx poisoning recovery control at the above described interval, the SOx storage amount Qs in the NOx catalyst 4 increases and decreases in cycles, as shown after the time point (a) in FIG. 2.

In contrast, when the operation of the internal combustion engine 1 is initially started, the SOx storage amount Qs in the NOx catalyst 4 gradually increases from substantially zero, as shown before the time point (a) in FIG. 2. At this time, SOx is stored in the NOx catalyst 4 from in the vicinity of the front end portion thereof.

Therefore, in early stages during which the operation of the internal combustion engine 1 is initially started and the SOx is stored in the vicinity of the front end portion of the NOx catalyst 4, it is difficult for the SOx stored in the NOx catalyst 4 to be reduced even if the SOx poisoning recovery control is carried out as described above. In addition, while the SOx is stored only in the vicinity of the front end portion of the NOx catalyst 4, the SOx storage amount Qs in the NOx catalyst 4 does not reach the maximum storage amount Qsmax.

Thus, according to the present embodiment, during the period from the initial start of the operation of the internal combustion engine 1 until the integrated amount of the fuel injected in the internal combustion engine 1 reaches a second predetermined integrated amount ΔQfen2 (at the time point (a) in FIG. 2), the execution of the SOx poisoning recovery control is prohibited. Here, the second predetermined integrated amount ΔQfen2 is an amount that allows a determination that the SOx amount in the NOx catalyst 4 has reached the minimum storage amount Qsmin from the point in time that the operation of the internal combustion engine 1 is initially started, that is, from the state in which the SOx is not stored in the NOx catalyst 4. The second predetermined integrated amount ΔQfen2 is determined in advance by carrying out an experiment or the like.

Thereby, the execution of the SOx poisoning recovery control is prohibited until the NOx catalyst starts storing the SOx that can be reduced by executing the SOx poisoning recovery control. Therefore, unnecessary execution of the SOx poisoning recovery control can be reduced.

That is, the SOx poisoning recovery control can be carried out at more advantageous timings, according to the present embodiment. As a result, deterioration in fuel economy and degradation of the NOx catalyst 4 can be suppressed.

Note that, in the present embodiment, the execution timing of the SOx poisoning recovery control may be controlled by using a traveling distance of the vehicle that is provided with the internal combustion engine 1 instead of the integrated amount of fuel injected in the internal combustion engine 1.

In addition, in the SOx poisoning recovery control according to the present embodiment, the fuel may supplied to the NOx catalyst by conducting a secondary injection in the internal combustion engine 1 instead of adding fuel from the fuel-adding valve 6.

While the invention has been described in terms of preferred embodiments, those skilled in the art will recognize that the invention can be practiced with modifications within the spirit and scope of the appended claims.

INDUSTRIAL APPLICABILITY

According to the present invention, in the exhaust purification system for an internal combustion engine including the NOx catalyst disposed in the exhaust passage of the internal combustion engine, the SOx poisoning recovery control can be executed at more advantageous timings. As a result, deterioration in fuel economy and degradation of the NOx catalyst can be suppressed.

The claimed invention is:

1. An exhaust purification system for an internal combustion engine, comprising:

a NOx storage-reduction catalyst that is disposed in an exhaust passage of said internal combustion engine, that stores NOx in exhaust gas when a surrounding atmosphere is an oxidative atmosphere, and that reduces stored NOx when said surrounding atmosphere is a reduction atmosphere;

fuel supply unit for supplying fuel to said NOx storage-reduction catalyst from an upstream side thereof; and SOx poisoning recovery control executing unit programmed to use said fuel supply unit to supply fuel to said NOx storage-reduction catalyst so as to raise a temperature of said NOx storage-reduction catalyst and cause said surrounding atmosphere to be said reduction atmosphere, thereby executing, at a predetermined interval during operation of said internal combustion engine, a SOx poisoning recovery control that reduces SOx stored in said NOx storage-reduction catalyst, wherein said SOx poisoning recovery control executing unit is programmed to start execution of the SOx poisoning recovery control when an amount of SOx stored in said NOx storage-reduction catalyst is estimated to have reached a maximum storage amount, and subsequently stops the execution of the SOx poisoning recovery control when the amount of SOx stored in the NOx storage-reduction catalyst is estimated to have reached a minimum storage amount, which is an amount of SOx that remains stored in the vicinity of the front end portion of said NOx storage-reduction catalyst even if the SOx poisoning recovery control is executed, wherein the predetermined interval is a time interval from the time at which the amount of SOx stored in said NOx storage-reduction catalyst is the minimum storage amount, to the time at which the amount of SOx is estimated to reach the maximum storage amount, and, the predetermined interval is a constant interval, and the execution of said SOx poisoning recovery control by said SOx poisoning recovery control executing unit is prohibited during a predetermined period starting from the point in time that the operation of said internal combustion engine is initially started, with said predetermined period being longer than said predetermined interval and being a period that lasts until the amount of SOx in said NOx storage-reduction catalyst has reached the minimum storage amount from the state in which the SOx is not stored in said NOx storage-reduction catalyst.

* * * * *